US005457080A

United States Patent [19]

Takano et al.

[11] Patent Number: 5,457,080

[45] Date of Patent: Oct. 10, 1995

[54] THERMAL RECORDING LABEL

[75] Inventors: Shinji Takano; Keiichi Maruta, both of Numazu, Japan

[73] Assignee: Ricoh Company, Ltd., Tokyo, Japan

[21] Appl. No.: 357,300

[22] Filed: Dec. 13, 1994

[30] Foreign Application Priority Data

Dec. 14, 1993 [JP] Japan ..... 5-342426
Dec. 9, 1994 [JP] Japan ..... 6-331856

[51] Int. Cl.[6] ..... B41M 5/30

[52] U.S. Cl. ..... 503/207; 428/345; 503/200; 503/226

[58] Field of Search ..... 427/152; 428/195, 428/206, 318.4, 323, 327, 340, 341, 345, 913, 914; 503/200, 207, 226

[56] References Cited

U.S. PATENT DOCUMENTS 4,123,309 10/1978 Perrington et al. ..... 156/234

FOREIGN PATENT DOCUMENTS 59-46265 3/1984 Japan .
59-43979 3/1984 Japan .
60-54842 3/1985 Japan .
63-303387 12/1988 Japan .
5-11573 3/1993 Japan .

*Primary Examiner*—Bruce H. Hess
*Attorney, Agent, or Firm*—Oblon, Spivak, McClelland, Maier & Neustadt

[57] ABSTRACT

A thermal-recording label includes a supporting body, a thermal coloring layer on one side of the supporting body, and a thermal adhesive layer on the other side of the supporting body, which thermal adhesive layer includes an infrared absorption substance.

13 Claims, 1 Drawing Sheet

THERMAL RECORDING LABEL

BACKGROUND OF THE INVENTION

1. Field of the Invention

The present invention generally relates to thermal-recording labels, and particularly relates to a thermal-recording label which has a thermal coloring layer on one side of a supporting sheet and a thermal adhesive layer on the other side, which adhesive layer is non-adhesive before activation and includes an infrared absorption substance.

2. Description of the Prior Art

Thermal-recording labels are widely used in various fields including the field of POS (point of sales) systems, and typically have a peeling sheet attached on an adhesive layer on the back surface thereof.

Although thermal-recording labels of a self-adhesive type as described above are effective for their intended purposes, there are various disadvantages associated with the peeling sheets, which are typically larger than the labels themselves. For example, an amount of a limited capacity of storage must be used for storing those large non-essential sheets, which are to be disposed of after using the labels. Also, those large sheets hinder to some extent work performance during sticking of the labels. Also, disposing of those large sheets after the sticking of the labels is not preferable from an ecological viewpoint. Furthermore, a cost of attaching the peeling sheets as well as a cost of the peeling sheets themselves adds to a cost of the thermal-recording labels.

In order to obviate the problems described above, self-adhesive thermal-recording labels without peeling sheets are disclosed in Japanese Laid-Open Utility Model Application No. 59-43979 and in Japanese Laid-Open Patent Applications No. 59-46265, and No. 60-54842. Those disclosures describe thermal-recording labels with an adhesive encapsulated in micro-capsules, thermal-recording labels with a detaching-agent layer for an adhesive provided on a protective layer, etc. However, the thermal-recording labels disclosed in those patent applications have defects such as a week tackiness of adhesives and a difficulty in printing on the thermal surface, and, thus, are not applied in practical use yet.

A method of using a thermal adhesive as a functional adhesive is disclosed in Japanese Laid-Open Patent Application No. 63-303387 and Japanese Laid-Open Utility Model Application No. 5-11573. Both of them use a foaming heat insulator or a non-foaming heat insulator as an intermediate layer. However, the thermal surface is subject to a direct exposure to hot air or heat from a heater when activating the thermal adhesive, and, thus, becomes colored. Also, a heater for providing thermal energy in order to activate the thermal adhesive tends to have a high temperature, so that the safety of the process can be compromised. Also, the easy handling of the thermal-recording labels can be diminished. Thus, the above-described methods are not preferable for practical purposes.

Accordingly, there is a need in the field of the thermal-recording labels for a thermal-recording label having no peeling sheet but a thermal adhesive layer which includes an infrared absorption substance and can be activated from a non-adhesive state to a adhesive state through a light to heat conversion, without compromising safety and without bringing about coloring on the thermal surface.

SUMMARY OF THE INVENTION

Accordingly, it is a general object of the present invention to provide a thermal-recording label which can satisfy the need described above.

It is another and more specific object of the present invention to provide a thermal-recording label having no peeling sheet but a thermal adhesive layer which includes an infrared absorption substance and can be activated from a non-adhesive state to a adhesive state through a light to heat conversion, without compromising safety and without bringing about coloring on the thermal surface.

In order to achieve the above objects, a thermal-recording label according to the present invention includes a supporting body, a thermal coloring layer on one side of the supporting body, and a thermal adhesive layer on the other side of the supporting body, which thermal adhesive layer includes an infrared absorption substance.

Also, in order to achieve the above objects, a thermal-recording label according to the present invention includes a supporting body, a thermal coloring layer on one side of the supporting body, a thermal adhesive layer on the other side of the supporting body, which thermal adhesive layer includes an infrared absorption substance, and a non-foaming insulator layer having a main component of hollow micro-particles made of a thermoplastic resin, which non-foaming insulator layer is provided between the supporting layer and the thermal coloring layer or provided both between the supporting layer and the thermal coloring layer and between the supporting layer and the thermal adhesive layer.

According to the present invention, the non-foaming insulator layer is provided between the supporting body and the thermal adhesive layer including an infrared absorption substance. Thus, thermal energy can be prevented from dispersing when light is illuminated, so that the heat conversion can be made efficiently. Also, the insulator layer can prevent heat transfer to the thermal coloring layer so as to avoid the coloring of the thermal surface. Thus, the insulator layer provided between the supporting layer and the thermal coloring layer or provided both between the supporting layer and the thermal coloring layer and between the supporting layer and the thermal adhesive layer can achieve the above objects.

Accordingly, compared to the prior art method of using hot air or a heater in order to activate a thermal adhesive, the thermal-recording label of the present invention has a less harmful effect of heat on the thermal surface because of the utilization of the light-to-heat conversion, thus preventing the coloring of the thermal surface.

Also, the non-foaming insulator layer provided between the supporting body and the thermal coloring layer leads to a more efficient use of thermal energy from a thermal head and the like so as to enhance the coloring sensitivity. In addition to that, the non-foaming insulator layer can prevent the thermal surface of the thermal coloring layer from coloring, when the energy of light illumination is applied in order to activate the thermal adhesive including the infrared absorption substance.

Furthermore, in the thermal-recording label according to the present invention, the hollow micro-particles have an average diameter ranging between 0.4 μm and 10 μm, and have a hollow rate more than 30%. This particular hollow rate brings about a heat insulation of a higher degree. Hollow particles with a hollow rate less than 30% are better than mere solid particles in terms of heat insulation. However, with such hollow particles of a hollow rate less than 30%, more thermal energy from a thermal head is released from the thermal-recording materials via the supporting body, thus reducing the coloring sensitivity. Also, a small heat insulation effect for heat produced by a light illumination results in less efficiency in activating the thermal adhesive, thus diminishing the tackiness of the adhesive.

Hollow micro-particles with an average diameter more than 10 μm brings about an irregularity on the surface of the intermediate layer, and, also, lead to an increase in the thickness of the layer. On the other hand, hollow micro-particles with an average diameter less than 0.4 μm are difficult to make with a desired hollow rate, thus leaving a problem in a manufacturing process as well as in a manufacturing cost.

Other objects and further features of the present invention will be apparent from the following detailed description when read in conjunction with the accompanying drawing.

DESCRIPTION OF THE PREFERRED EMBODIMENTS

Figure 1:
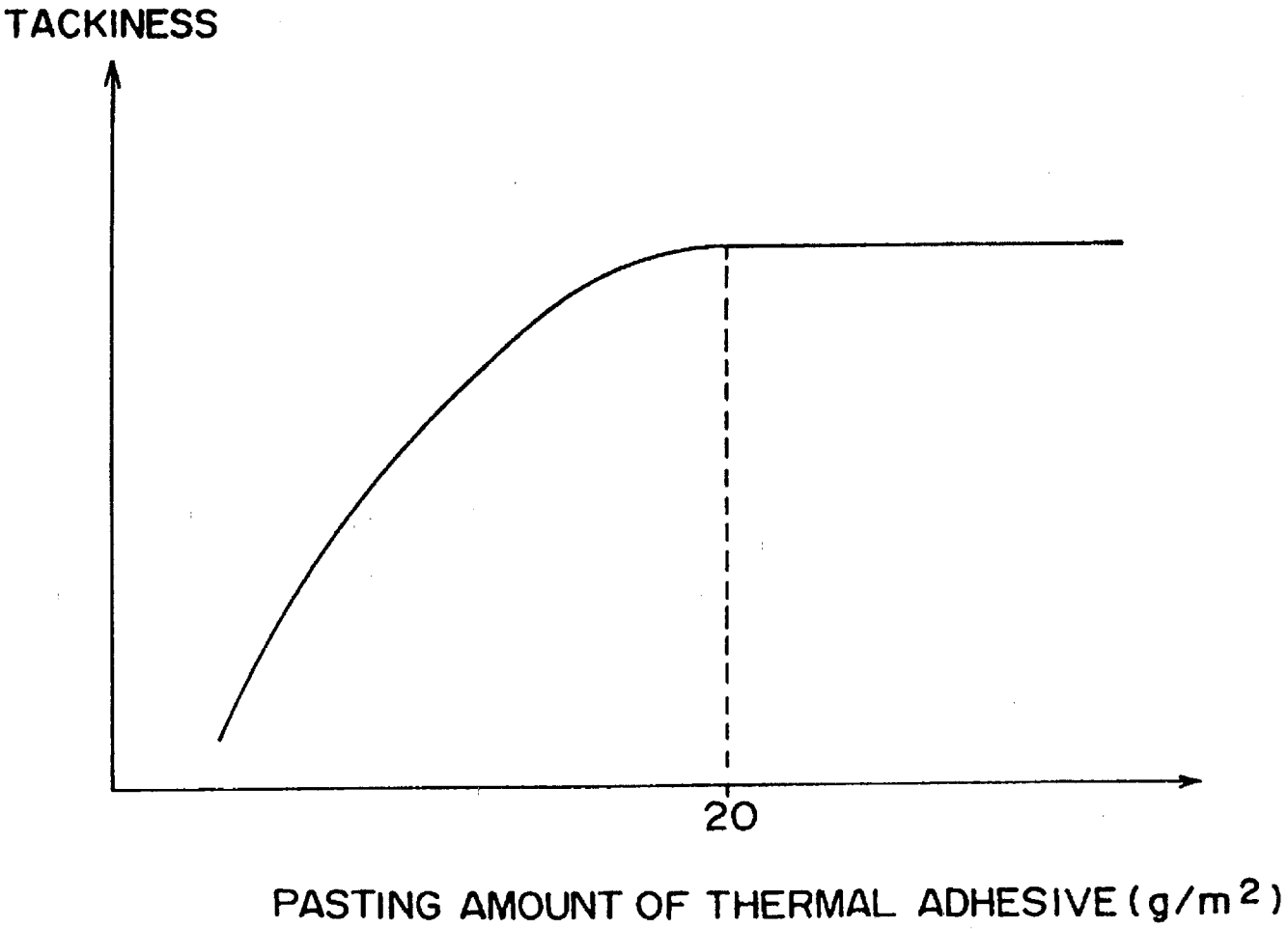
FIG. 1 is a relationship between a pasting amount of a thermal adhesive layer and its tackiness when using graphite as an infrared absorption substance.

In the following, an embodiment of the present invention will be described.

As a thermoplastic resin used for hollow micro-particles, one of the following or a copolymer of the following can be used: a styrene resin such as polystyrene, poly-α-methyl styrene, and poly-β-methyl styrene; an acryl resin such as polymethyl methacrylate, polyethyl methacrylate, polyisopropyl methacrylate, polyisobutyl methacrylate, polyacrylonitrile, and polymethacrylonitrile; polyvinyl chloride, polytetrafluoroethylene, polyvinyl alcohol, poly-o-vinyl benzyl alcohol, poly-a-vinyl benzyl alcohol, poly-p-vinyl benzyl alcohol, polyvinyl formal, polyvinyl acetal, polyvinyl propional, polyvinyl butyral, polyvinyl isobutyral, polyvinyl-tert-butylether, polyvinylpyrrolidone, polyvinylcarbazole, cellulose acetate, cellulose triacetate, and polycarbonate. Among those, a styrene resin, a styrene/acryl copolymer resin, and a vinylidene chloride/acrylonitrile copolymer resin are particularly effective in heat insulation when used for hollow micro-particles.

In order to provide a non-foaming insulator layer between the supporting body and the thermal adhesive layer or between a supporting body and a thermal coloring layer, the hollow micro-particles are dispersed into water along with a well-known binder such as a water-soluble polymer or a water-macromolecule emulsion. Then, this solution is pasted on the surface of the supporting layer, and, then, is dried. In doing so, an amount of the hollow micro-particles pasted on the supporting body is at least 1 $g/m^2$, and preferably 2 to 15 $g/m^2$. An amount of the binder resin pasted on the supporting body is appropriate when an intermediate layer can be sturdily fixed to the supporting body. Typically, the amount of the binder resin is about 2 to 50 weight % of a total weight of the binder resin plus the hollow micro-particles.

In the present invention, a binder used for forming the non-foaming insulator layer is selected from water-soluble polymers and/or water-macromolecule emulsions well-known to the art. Examples of water-soluble polymers include polyvinyl alcohol, starch and its derivatives, cellulose derivatives such as methoxy cellulose, hydroxy ethyl cellulose, carboxymethyl cellulose, methyl cellulose, and ethyl cellulose, sodium polyacrylate, polyvinylpyrrolidone, an acrylamide/acrylate copolymer, an acrylamide/acrylate/methacrylic copolymer, a styrene/maleic anhydride copolymer alkali salt, an isobutylene/maleic anhydride copolymer alkali salt, polyacrylamide, sodium alginate, gelatin, casein, etc. As for water-macromolecule emulsions, latexes such as a styrene/butadiene copolymer and a styrene/butadiene/acryl copolymer, a vinyl acetate resin, a vinyl acetate/acrylic acid copolymer, a styrene/acrylate copolymer, an acrylate resin, a polyurethane resin, etc., can be used.

In the non-foaming insulator layer, a supplemental additive component which is typically used in such thermal-recording substances as in this case can be employed along with the binder and the hollow micro-particles (possibly pigment). Such a supplemental additive component includes thermoplastic materials and surface-active agents. Examples of the thermoplastic materials will be given later in conjunction with substances for the thermal-recording layer.

A preferable infrared absorption substance in the present invention effectively absorbs light in an infrared region of wavelengths ranging from 0.7 μm to 2.5 μm. Organic or inorganic compounds which can convert light into heat can be used for such an infrared absorption substance.

Examples of organic infrared absorption substances include a cyanine dye, an azulenium dye, a pyrylium or thiopyrilium dye, scwarilium dye, a triarylmethane dye, an immonium or diimmonium dye, a thiolnickel complex salt dye, a phthalocyanine dye, a naphthalocyanine dye, anthraquinone dye, triphenylphosphate, 2-ethylhexyldiphenylphosphate, furfuryl acetate, bis(1-thio-2-phenolate)nickel-tetrabutylammonium, bis(1-thio-2-naphtorate)nickel-tetrabutylammonium, 1,1-diethyl-4,4-quinocarboncyanineiodide, and 1,1'-diethyl-6,6'-dichloro-4,6'-quinotricarboncyanineiodide.

Examples of inorganic compounds include metal oxide such as aluminium oxide; metal hydroxide such as aluminium hydroxide and magnesium hydroxide; silicate minerals such as a mica family, a feldspar family, silica minerals, and clay minerals; silicate compounds such as willemite, magnesium silicate, calcium silicate, and barium silicate; phosphate compounds such as zinc phosphate; nitride compounds such as trisilicon tetranitride and boron nitride; sulfate compounds such as barium sulfate, calcium sulfate, and strontium sulfate; carbonate compounds such as calcium carbonate, barium carbonate, magnesium carbonate, and zinc carbonate; nitrate compounds such as potassium nitrate; natural graphite such as scale graphite, granular graphite, rock graphite, and mud graphite; and artificial graphite. A list of examples of inorganic compounds is not limited to those cited above.

Infrared absorption substances include dispersed infrared absorption substances which cannot be dissolved by solutions, and dissolved infrared absorption substances which can be dissolved by solutions. Both substances can be used in the present invention. The dispersed infrared absorption substances have a dark color such as a black color or a black-gray color, and have a strong and wide absorption band in a near infrared region of wavelengths between 0.7 to 2.5 μm, within which band the absorption is almost flat. Compared to the dissolved infrared absorption substances, the dispersed infrared absorption substances have a higher light-to-heat conversion rate. Also, since the dispersed infrared absorption substances have an inherent characteristic that their functional stability can be sustained over a long time, the thermal adhesive can exhibit a strong tackiness even after the passage of a long time.

Any dispersed infrared absorption substance can be employed in the present invention as long as it exhibits a flat and strong absorption band for wavelengths between 0.7 μm to 2.5 μm of light to be converted into heat. However, graphite is particularly preferable for use in the present invention.

Preferably, the infrared absorption substance is used in a form of micro-particles, and an average diameter of the micro-particles is preferably less than 2.0 μm. A method of turning the substance into micro-particles includes a typical dry or wet grinding method and a chemical process using a dissolved colloid. Once graphite with a dispersion characteristic is turned into micro-particles, the graphite is superior to any other infrared absorption substance or dye in absorption efficiency and in the light-to-heat conversion rate, thus providing a better thermal adhesive. This may be because turning graphite into micro-particles substantially increases the total surface area of the graphite, leading to the enhancement of the absorption efficiency. As an example, different average particle diameters are shown with their corresponding tackiness in TABLE 1.

TABLE 1

| infrared absorption substance | average particle diameter | tackiness | surface concentration |
|---|---|---|---|
| phthalocyaninecobalt | 2.0 μm | good | 0.09 |
| phthalocyaninecobalt | 5.0 μm | fair | 0.09 |

A dark color of an infrared absorption substance, especially graphite, can have a harmful effect on the thermal surface, so that the amount of the substance should be made as small as possible. Preferably, the amount of the substance in the thermal adhesive layer is between 0.02 to 0.1 g/m$^2$. If the amount of the infrared absorption substance is greater than 0.1 g/m$^2$ in the thermal adhesive layer, the thermal adhesive layer can become excessively dark. Also, a tinged color of the thermal surface and an excessive amount of the infrared absorption substance lead to an excessive absorption of infrared light energy. Thus, when light is converted into heat for an activation of the thermal adhesive, the thermal surface can be colored. On the other hand, if the amount of the infrared absorption substance in the thermal adhesive layer is smaller than 0.05 weight %, an efficiency of the light-to-heat conversion is reduced. Thus, the thermal adhesive cannot be activated to exhibit tackiness even when infrared light is illuminated.

Accordingly, making the amount of the infrared absorption substance within an appropriate range leads to a balance between the tackiness and the thermal surface concentration. Thus, a thermal-recording label suitable for a practical use which does not require a peeling sheet can be obtained. As an example, different amounts of the infrared absorption substance when using graphite are shown along with their corresponding tackiness in TABLE 2.

TABLE 2

| infrared absorption substance | amount | tackiness | surface concentration |
|---|---|---|---|
| graphite | 0.2 g/m$^2$ | excellent | 0.28 |
| graphite | 0.1 g/m$^2$ | excellent | 0.13 |
| graphite | 0.05 g/m$^2$ | good | 0.12 |

TABLE 2-continued

| infrared absorption substance | amount | tackiness | surface concentration |
|---|---|---|---|
| graphite | 0.02 g/m$^2$ | good | 0.11 |
| graphite | 0.01 g/m$^2$ | fair | 0.10 |
| graphite | 0.005 g/m$^2$ | poor | 0.08 |
| graphite | 0 g/m$^2$ | poor | 0.08 |

Graphite as an infrared absorption substance is mixed with the thermal adhesive in a proportion specified in the claims, and, then, is pasted. Depending on the amount of infrared light energy inducing an activation, the pasting amount may be changed. However, the pasting amount of the thermal adhesive layer is preferably greater than 20 g/m$^2$. If it becomes below the noted amount, not only is the initial tackiness after the light-to-heat conversion inadequate, but also the tackiness tends to decrease with the passage of time. Furthermore, an increase in the pasting amount of the thermal adhesive layer in excess of 20 g/m$^2$ does not bring about any increase in the initial tackiness nor in the later tackiness. As an example, a relationship between the pasting amount of the thermal adhesive layer and the tackiness when using graphite as an infrared absorption substance is shown in FIG. 1.

Thermal adhesives usable in the present invention include:

(a) macromolecule resins such as polyvinyl acetate, polybutyl methacrylate, vinyl acetate-vinylidene chloride copolymer, synthetic rubber, a vinyl acetate-acrylate2-ethylhexyl copolymer, a vinyl acetate-ethylene copolymer, vinylpyrrolidone, a styrene copolymer, a styrene-butadiene copolymer, and a vinylpyrrolidone-ethyl acrylate copolymer, (b) plasticizers which are solid in room temperature such as diphenyl phthalate, dihexyl phthalate, dicyclohexyl phthalate, dihydroabiethyl phthalate, dimethyl isophthalate, sucrose benzoate, ethylene glycol dibenzoate, trimethylolathane tribenzoate, glyceride tribenzoate, pentaerythrite tetrabenzoate, sucrose octaacetate, tricyclohexyl citrate, and N-cyclohexyl-p-trienesulfonamide, (c) substances containing cohesive additives such as rosin derivatives (rosin, polymer rosin, and hydrorosin, or their ester, resin acid dimer, etc., with glycerol or pentaerythritol), a terpene resin, a petroleum resin, a phenol resin, and a xylen resin.

An example of a composition for a thermal adhesive is shown in the following. However, a composition used in the present invention is not limited to this example.

| | |
|---|---|
| styrene-butadiene copolymer | 30–70 weight parts |
| dicyclohexyl phthalate | 2–15 weight parts |
| pentaerythritol tetrabenzoate | 20–60 weight parts |

As a light source for converting light into heat, an infrared lamp such as a Xe flash lamp, a quartz flash lamp, a halogen lamp, or a mercury lamp, each of which includes an infrared region with wavelengths ranging from 0.7 to 20 μm, can be used. Among those lamps, an appropriate lamp can be selected in accordance with the characteristics and the conversion efficiency of the infrared absorption substance included in the thermal adhesive layer.

A leuco dye used for the thermal-recording layer of the present invention is used alone or mixed with other leuco dyes. In the present invention, any leuco dyes which are typically applied to such thermal materials as in this case can be used. For example, leuco compounds of dyes such as triphenylmethane, fluoran, phenothiazine, auramine, spiropyran, indophthalide are often used. Examples of such leuco dyes include the following:

3,3-bis(p-dimethylaminophenyl)-phthalide, 3,3-bis(p-dimethylaminophenyl)-6-dimethylaminophthalide (also, called crystal violet lactone), 3,3-bis(p-dimethylaminophenyl)-6-diethylaminophthalide, 3,3-bis(p-dimethylaminophenyl)-6-chlorphthalide, 3,3-bis(p-dibutylaminophenyl)-phthalide, 3-cyclohexylamino-6-chlorfluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorfluoran, 3-(N-p-tolyl-N-ethylamino)-6-methyl-7-anilinofluoran, 3-pyrrolidino-6-methyl-7-anilinofluoran, 2-{N-(3'-trifluoromethylphenyl)amino}-6-diethylaminofluoran, 2-{3,6-bis(diethylamino)-9-(o-choranilino}lactam xanthylbenzoate, 3-diethylamino-6-methyl-7-(m-trichloromethylanilino)fluoran, 3-diethylamino-7-(o-chloranilino)fluoran, 3-di-n-butylamino-7-(o-chloranilino)fluoran, 3-N-methyl-N,n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzilamino)fluoran, benzoyl leuco methyleneblue, 6'-chloro-8'-methoxy-benzoindolyno-spiropyran, 6'-bromo-3'-methoxy-benzoindolyno-spiropyran, 3-(2'-hydroxy-4'-dimethylaminophenyl)-3(2'-methoxy-5'-chlorphenyl)phthalide, 3-(2'-hydroxy-4'-dimethylaminophenyl)-3-(2'-methoxy-5'-nitrophenyl)phthalide, 3-(2'-hydroxy-4'-dimethylaminophenyl)-3-(2'-methoxy-5'-methylphenyl)phthalide, 3-(2'-methoxy-4'-dimethylaminophenyl)-3-(2'-hydroxy-4'-chlor-5'-methylphenyl)phthalide, 3-(N-ethyl-N-tetrahydrofurfuryl)amino-6-methyl-7-anilinofluoran, 3-N-ethyl-N-(2-ethoxypropyl)amino-6-methyl-7-anilinofluoran, 3-N-methyl-N-isobutyl-6-methyl-7-anilinofluoran, 3-morpholino-7-m-trifluoromethylanilino)fluoran, 3-pyrrolidino-7-m-trifluoromethylanilinofluoran, 3-diethylamino-5-chloro-7-(N-benzyltrifluoromethylanilino)fluoran, 3-pyrrolidino-7-(di-p-chlorphenyl)methylaminofluoran, 3-diethylamino-5-chlor-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-methyl-N-isopropylamino)-6-methyl-7-anilinofluoran, 3-di-n-butylamino-6-methyl-7-anilinofluoran, 3,6-bis(dimethylamino)fluorenespiro(9,3')-6'-dimethylaminophthalide, 3-(N-benzil-N-cyclohexylamino)-5,6'-benzo-7-α-naphthylamino-4'-bromofluoran, 3-diethylamino-6-chlor-7-anilinofluoran, 3-diethylamino-6-methyl-7-mesidino-4,5'-benzofluoran, 3-N-methyl-N-isopropyl-6-methyl-7-anilinofluoran, 3-N-ethyl-N-isoamyl-6-methyl-7-anilinofluoran, 3-diethylamino-6-methyl-7-(2',4'-dimethylanilino)fluoran.

Lauco dyes usable in the present invention are not limited to the examples cited above.

As a developer for the thermal-recording layer of the present invention, various compounds, oxidizing agents, etc., with an electron accepting characteristic, which make the above leuco dyes colored upon a contact with the leuco dyes, are used. Such developers are known to the art, and examples can be named as follows:

4,4'-isopropylidenediphenol, 4,4'-isopropylidenebis(o-methylphenol), 4,4'-secondarybutylidenebisphenol, 4,4'-isopropylidenebis(2-tert-butylphenol), p-zinc nitrobenzoate, 1,3,5-tris(4-tert-butyl-3-hydroxy-2,6-dimethylbenzyl)isocyanurate, 2,2-(3,4'-dihydroxydiphenyl)propane, bis(4-hydroxy-3-methylphenyl)sulfide, 4-{β-(p-methoxyphenoxy)ethoxy}salicylate, 1,7-bis(4-hydroxy-3-phenylthio)-3,5-dioxaheptane, 1,5-bis(4-hydroxy-3-phenylthio)-5-oxapentane, monobenzylester phthalate monocalcium salt, 4,4'-cyclohexylydenediphenol, 4,4'-isopropylidenebis(2-chlorophenol), 2,2'-methylenebis(4-methyl-6-tert-butylphenol), 4,4'-butylidenebis(6-tert-butyl-2-methyl)phenol, 1,1,3-tris(2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methyl)phenol, 4,4'-diphenolsulfone, 4-isopropoxy-4'-hydroxydiphenylsulfone, 4-benzyloxy-4'-hydroxydiphenylsulfone, 4,4'-diphenolsulfoxide, P-isopropyl hydroxybenzoate, P-benzyl hydroxybenzoate, benzyl protocatechuic acid, stearyl gallate, lauryl gallate, octyl gallate, 1,3-bis(4-hydroxyphenylthio)-propane, N,N'-diphenylthiourea, N,N'-di(m-chlorophenyl)thiourea,
salicyl anilide,
bis-(4-hydroxyphenyl)methyl acetate,
bis-(4-hydroxyphenyl)benzyl acetate,
1,3-bis(4-hydroxychmyl)benzene,
1,4-bis(4-hydroxychmyl)benzene,
2,4'-diphenolsulfone,
2,2'-diallyl-4,4'-diphenolsulfone,
3,4-dihydroxyphenyl-4'-methyldiphenylsulfone,
1-acetyloxy-2-zinc naphthoic acid,
2-acetyloxy-1-zinc naphthoic acid,
2-acetyloxy-3-zinc naphthoic acid,
α,α-bis(4-hydroxyphenyl)-α-methyltoluene,
antipyrine complex of zinc thiocyanate,
tetrabromobisphenol A,
tetrabromobisphenol S,
4,4'-thiobis(2-methylphenol),
4,4'-thiobis(2-chlorophenol).

Developers usable in the present invention are not limited to those cited above.

In the thermal-recording layer of the present invention, the leuco dyes and the developers can be pasted on the intermediate layer by using various binders typically used in the art. Examples of the binders may be the same as those cited before with regard to the pasting of the intermediate layer.

In the thermal-recoding layer of the present invention, supplement additive components typically used in such a thermal-recording layer are used along with the leuco dyes and the developers, when they become necessary. Such supplement additive components include, for example, pigments, thermoplastic substances, surface-active agents, etc. Such pigments include, for example, inorganic micro-particles of calcium carbonate, silica, zinc oxide, titanium oxide, aluminium hydroxide, zinc hydroxide, barium sulfate, clay, talc, calcium or silica with surfaces being treated, etc., and organic miro-particles of an urea-formalin resin, a styrene/methacrylate copolymer, a polystyrene resin, etc. Also, such supplement additive components include, for example, higher fatty acids or their ester, amido or metal salt, various waxes, a condensation product of an aromatic carboxylic acid and amine, phenylester benzoate, higher linear glycol, 3,4-epoxy-dialkyl hexahydrophthalate, higher ketone, and thermoplastic organic compounds and the like having a melting point of 50° to 200° C.

The thermal-recording materials of the present invention can be provided with a protective layer on the thermal coloring layer, for such purposes as enhancing the matching of a thermal head and enhancing the durability of recorded images. Components constituting the protective layer include the fillers, the binders, the surface-active agents, and the thermoplastic substances as noted hereinbefore.

The above-described materials for each layer are pasted and dried, so that the thermal-recording material pasted on an appropriate supporting body such as paper, synthetic paper, or a plastic film is obtained to be applied to various fields relating to thermal recording.

In the following, the present invention will be described further in detail with reference to embodiments. In a following description, the "parts" and "%" notations refer to weight measures.

FIRST EMBODIMENT

| Solution A: dye dispersion solution | |
|---|---|
| 3-dibenzylamino-6-methyl -7-anilinofluoran | 20 parts |
| polyvinyl alcohol 10% aqueous solution | 20 parts |
| water | 60 parts |
| **Solution B: developer dispersion solution** | |
| 4-4'-dihydroxybenzophenone | 10 parts |
| polyvinyl alcohol 10% aqueous solution | 25 parts |
| calcium carbonate | 15 parts |
| water | 50 parts |

Mixtures having the above compositions are dispersed by using a sand mill so as to have an average diameter less than 2.0 μm. Thus, the solution A and the solution B are obtained.

Then, those two solutions are mixed with the weight ratio of the solution A to the solution B being 1 to 8, and are stirred to obtain a thermal paste solution C.

| Solution D: | |
|---|---|
| hollow micro-particle dispersion system of styrene/acryl copolymer (30% hollow rate, 0.4 μm average particle diameter, 37.5% solid part concentration) | 30 parts |
| styrene/butadiene copolymer latex (47.5% solid part concentration) | 10 parts |
| water | 60 parts |

A mixture having the above composition is stirred and dispersed to obtain a non-foaming insulator layer solution, which is then pasted on a front surface of a piece of commercially available high-quality paper (52 g/m$^2$) such that its pasted and dried weight is 5 g/m$^2$. The pasted solution is dried to obtain a sheet having the non-foaming insulator layer.

Then, the thermal paste solution C is pasted on the non-foaming insulator layer of the above sheet such that its pasted and dried weight is 5 g/m$^2$, thus providing a thermal coloring layer. Then, the layer is treated by means of a super calendering treatment so as to have the Beck smoothness of 600 to 700 seconds. Thus, a sheet having the thermal coloring layer (and the non-foaming insulator layer) is obtained.

| Solution E: | |
|---|---|
| thermal adhesive (Redetex corp. prototype DT-200, 58% solid part concentration) | 90 parts |
| dispersed graphite (Sumika-color corp. polux-black P-PB, 38% solid part concentration) | 0.1 parts |
| water | 9.9 parts |

A thermal adhesive paste having the above composition and including an infrared absorption substance is pasted on a back surface of the sheet having the thermal coloring layer, such that its pasted and dried weight is 25 g/m$^2$. Then, the thermal adhesive layer is dried so that a sample of the first embodiment is obtained.

SECOND EMBODIMENT

The solution D of the first embodiment is pasted on the back surface of the sheet having the thermal coloring layer such that its pasted and dried weight is 5 g/m$^2$, thus providing a non-forming insulator layer. Then, the solution E of the first embodiment is pasted on the non-foaming insulator layer such that its pasted and dried weight is 25 g/m$^2$. A sample of the second embodiment is thus obtained.

THIRD EMBODIMENT

In the third embodiment, a hollow micro-particle dispersion system of a styrene/acryl copolymer (50% hollow rate, 1.0 μm average particle diameter, 27.5% solid part concentration) is used instead of the solution D of the first embodiment. Anything other than this difference is the same as the first embodiment.

FOURTH EMBODIMENT

In the fourth embodiment, a non-foaming insulator layer is provided between the supporting paper and the thermal adhesive layer of the third embodiment. Namely, the hollow micro-particle dispersion system of the third embodiment is pasted on the back surface so as to form the non-foaming insulator layer having the weight of 5 g/m$^2$. Then, the solution E of the first embodiment is pasted on the non-foaming insulator layer such that its pasted and dried weight is 25 g/m$^2$. A sample of the fourth embodiment is thus obtained.

FIFTH EMBODIMENT

In the fifth embodiment, a hollow micro-particle dispersion system of a vinylidene chloride/acrylonitrile copolymer (92% hollow rate, 5.0 μm average particle diameter, 29.0% solid part concentration) is used instead of the solution D of the first embodiment. Anything other than this difference is the same as the first embodiment.

SIXTH EMBODIMENT

In the sixth embodiment, a non-foaming insulator layer is provided between the supporting paper and the thermal adhesive layer of the fifth embodiment. Namely, the hollow micro-particle dispersion system of the fifth embodiment is pasted on the back surface so as to form the non-foaming insulator layer having the weight of 5 g/m$^2$. Then, the solution E of the first embodiment is pasted on the non-foaming insulator layer such that its pasted and dried weight is 25 g/m$^2$. A sample of the sixth embodiment is thus obtained.

In the following, samples for comparison with the above embodiments will be described.

FIRST SAMPLE FOR COMPARISON

A first sample for comparison differs from the sample of the first embodiment only in that the solution D is not pasted, i.e., the non-foaming insulator layer is not provided.

SECOND SAMPLE FOR COMPARISON

A second sample for comparison differs from the sample of the first embodiment only in that a hollow micro-particle dispersion system of a styrene/acryl copolymer (10% hollow rate, 0.55 μm average particle diameter, 48.0% solid part concentration) is used instead of the solution B.

THIRD SAMPLE FOR COMPARISON

A third sample for comparison differs from the sample of the first embodiment only in that a hollow micro-particle dispersion system of styrene/acryl copolymer (10% hollow rate, 0.3 μm average particle diameter, 49.0% solid part concentration) is used instead of the solution B.

Tests are conducted on the various thermal-recording labels obtained as described above, in order to examine the dynamic coloring sensitivity of the thermal coloring layers and the degree of the thermal surface coloring caused by heat converted from light which is illuminated upon the thermal adhesives. Those tests will be described below.

TEST OF DYNAMIC COLORING SENSITIVITY

Using a thermal-printing testing device having a thin-layered head of the Matsushita Electronic Component Corp., letters are printed on the thermal-recording labels with the head electric power of 0.60 W/dot, the recording time per line of 10 msec/line, and the pulse width of 0.4, 0.6, 0.8, and 1.0 msec. The density of the printed letters are then measured by a Macbeth densitometer RD-914.

TEST OF THERMAL SURFACE COLORING BY LIGHT ILLUMINATION

The thermal-recording labels are pasted on a polyester so that the thermal adhesive layer on the back surfaces including the infrared absorption substance is exposed to the light of a 3H Transparency Maker (1350 W halogen lamp). The thermal-recording labels are passed through the front of the halogen lamp at a speed of 2.5 inch/sec. After the light illumination, the thermal surface coloring of the thermal coloring layer is measured by the Macbeth densitometer RD-914.

Results of the above tests are shown in the following.

TABLE 3

| | Dynamic Coloring Sensitivity | | | | Thermal Coloring |
|---|---|---|---|---|---|
| | 0.4 ms | 0.5 ms | 0.6 ms | 0.7 ms | Density |
| Embodiments | | | | | |
| First | 0.13 | 0.28 | 0.53 | 0.82 | 0.13 |
| Second | 0.14 | 0.28 | 0.55 | 0.81 | 0.09 |
| Third | 0.20 | 0.37 | 0.70 | 0.99 | 0.11 |
| Fourth | 0.19 | 0.35 | 0.71 | 1.01 | 0.08 |
| Fifth | 0.29 | 0.48 | 0.83 | 1.13 | 0.08 |
| Sixth | 0.20 | 0.50 | 0.85 | 1.14 | 0.06 |
| Comparison | | | | | |
| First | 0.07 | 0.16 | 0.38 | 0.63 | 0.42 |
| Second | 0.10 | 0.22 | 0.43 | 0.73 | 0.21 |
| Third | 0.11 | 0.21 | 0.46 | 0.74 | 0.22 |

As shown in the results of TABLE 3, the thermal-recording labels of the present invention is viable for practical purposes as a label which does not require a peeling sheet and has a thermal adhesive capable of being activated by heat converted from illuminated light.

Further, the present invention is not limited to these embodiments, but various variations and modifications may be made without departing from the scope of the present invention.

What is claimed is:

1. A thermal-recording label comprising:

a supporting body;

a thermal coloring layer on one side of said supporting body; and a thermal adhesive layer on the other side of said supporting body, said thermal adhesive layer including an infrared absorption substance.

2. The thermal-recording label as claimed in claim 1, wherein said infrared absorption substance comprises a dispersed infrared absorption substance which has an absorption band in an infrared region of wavelengths ranging from 0.7 μm to 2.5 μm.

3. The thermal-recording label as claimed in claim 1, wherein said infrared absorption substance comprises graphite.

4. The thermal-recording label as claimed in claim 1, wherein said infrared absorption substance comprises particles with diameters less than 2 μm.

5. The thermal-recording label as claimed in claim 1, wherein an amount of said infrared absorption substance included in said thermal adhesive layer ranges from 0.02 $g/m^2$ to 0.1 $g/m^2$.

6. The thermal-recording label as claimed in claim 1, wherein a weight of said thermal adhesive layer is greater than 20 $g/m^2$.

7. A thermal-recording label comprising:

a supporting body;

a thermal coloring layer on one side of said supporting body;

a thermal adhesive layer on the other side of said supporting body, said thermal adhesive layer including an infrared absorption substance; and a non-foaming insulator layer having a main component of hollow micro-particles made of a thermoplastic resin, said non-foaming insulator layer being provided between said supporting layer and said thermal coloring layer or being provided both between said supporting layer and said thermal coloring layer and between said supporting layer and said thermal adhesive layer.

8. The thermal-recording label as claimed in claim 7, wherein said infrared absorption substance comprises a dispersed infrared absorption substance which has an absorption band in an infrared region of wavelengths ranging from 0.7 μm to 2.5 μm.

9. The thermal-recording label as claimed in claim 7, wherein said infrared absorption substance comprises graphite.

10. The thermal-recording label as claimed in claim 7, wherein said infrared absorption substance comprises particles with diameters less than 2 μm.

11. The thermal-recording label as claimed in claim 7, wherein an amount of said infrared absorption substance included in said thermal adhesive layer ranges from 0.02 $g/m^2$ to 0.1 $g/m^2$.

12. The thermal-recording label as claimed in claim 7, wherein a weight of said thermal adhesive layer is greater than 20 $g/m^2$.

13. The thermal-recording label as claimed in claim 7, wherein said hollow micro-particles have an average diameter within a range of 0.4 μm to 10 μm and have a hollow rate more than 30%.

* * * * *